US006216686B1

(12) United States Patent
Chiu

(10) Patent No.: US 6,216,686 B1
(45) Date of Patent: Apr. 17, 2001

(54) SLANTED MOTOR HOUSING FOR RANGE HOOD

(76) Inventor: Robert Chiu, 1442 S. San Gabriel Blvd., San Gabriel, CA (US) 91776

( * ) Notice: Subject to any disclaimer, the term of this patent is extended or adjusted under 35 U.S.C. 154(b) by 0 days.

(21) Appl. No.: 09/602,062

(22) Filed: Jun. 23, 2000

(51) Int. Cl.[7] ..... F24C 15/20

(52) U.S. Cl. ..... 126/299 R; 126/299 D; 454/62; 454/67

(58) Field of Search ..... 126/299 R, 299 D, 126/300, 301, 299 E, 299 F, 312; 55/DIG. 36; 454/49, 56, 61, 62, 67

(56) References Cited

U.S. PATENT DOCUMENTS 5,027,790 * 7/1991 Chern ..... 126/299 R
5,230,327 * 7/1993 Jang et al. ..... 126/299 R
6,044,838 * 4/2000 Deng ..... 126/299 D

FOREIGN PATENT DOCUMENTS 1-210740 * 8/1989 (JP) .
1-318840 * 12/1989 (JP) .

* cited by examiner

*Primary Examiner*—Ira S. Lazarus
*Assistant Examiner*—Josiah C. Cocks
(74) *Attorney, Agent, or Firm*—Raymond Y. Chan; David and Raymond Patent Group

(57) ABSTRACT

A range hood includes a motor housing having two slanted motor supporting platforms provided thereon wherein two motor are detachably mounted on the two slanted motor supporting platforms respectively such that the motors are inclined with respect to a ceiling of a casing. A drag area provided by the inclined motor arrangement is highly increased in order cover the entire cooking surface. Furthermore, all parts of the range hood are adapted to be assembled and disassembled without using tools such that a user is able to easily clean up the range hood part by part in which the parts made of durable material are dishwasher-safe so as to easily maintain the range hood for better performance.

20 Claims, 4 Drawing Sheets

SLANTED MOTOR HOUSING FOR RANGE HOOD

BACKGROUND OF THE PRESENT INVENTION

1. Field of Invention

The present invention relates to range hoods, and more particularly to a slanted motor housing for range hood which is adapted to be dissembled for easy clean-up and can highly increase the efficiency of filtering out cooking contaminants such as grease, odor, and grease risen from the cooking burners before they mix with the rest of the air in the home.

2. Description of Related Arts

When we cook foods at home, pollutants such as greases, odor, and hazardous gas are created. Home cooking can produce over gallons of vaporized grease, especially grease forms an extremely tough film that sticks like glue to everything it touches. So, grease created in cooking must be collected and removed from the home.

In order to filter out the cooking contaminants, most family have a range hood installed directly above the cooking burners of the gas or electric range such that vaporized grease produced during cooking can be dragged to the range hood so as to remove the cooking contaminants. There are two types of range hood in the market, which are ducted hood and ductless hood, wherein the ducted hood vents contaminated air to the outside and the ductless hood pulls air through a grease filter and a charcoal filter to clean the air which is then returned into the room. No matter which type of range hood is used, the purpose of the range hood is to remove cooking contaminants before they mix with the rest of the air in home.

The two types of range hood have a common structure design wherein a pair of motors are horizontally installed in a hood body. The two motors are arranged to drive a pair of fans to exhaust the vaporized grease into the hood body. In other words, the motors are horizontally positioned right above the cooking stove or range such that the fans will directly exhaust the vaporized grease over the cooking stove or range.

A suction area is provided directly under the fan driven by the motors. Usually, the suction area can cover the cooking range having a pair of burners in which the two fans are vertically aligned with the two cooking burners. However, when there are four cooking burners in a stove, such as an American style, the suction area of the range hood can only partially cover the entire cooking surface, especially the two front cooking burners. So, some vaporized grease may escape from the suction area, and especially when the user stands in front of the stove, his or her body may absorb some vaporized grease containing hazardous gas that may hazard his or her health.

Furthermore, when the vaporized grease is sucked into the range hood, the grease will stick to the hood casing, fans, and even motors. In order to maintain the high performance of the range hood, regularly clean up the range hood is needed. User usually has difficulty to clean up the range hood because all parts in the range hood are assembled by manufacturer, which are very seldom to be disassembled for clean up individually. So, the user can hardly clean up all single part in detail, especially the interior parts, while the range hood is installed in such upper position without uninstalling the parts from the range hood.

SUMMARY OF THE PRESENT INVENTION

A main object of the present invention is to provide a slanted motor housing for range hood which can easily be disassembled and be re-assembled by the user for easy clean up.

Another object of the present invention is to provide a slanted motor housing for range hood which can highly increase the efficiency of filtering out the cooking contaminants from the cooking stove or range.

Another object of the present invention is to provide a slanted motor housing for range hood which can effectively increase the suction area for the cooking stove or range.

Another object of the present invention is to provide a slanted motor housing for range hood wherein the grease after filtration may easily to drain off and be collected from the range hood.

Accordingly, in order to accomplish the above objects, the present invention provides a slanted motor housing for range hood, which comprises:

- a casing having a box shaped structure comprising a ceiling adapted for horizontally mounted on a ceiling of a kitchen;
- a motor housing detachably mounted under the ceiling of the casing, wherein the motor housing having two slanted motor supporting platforms downwardly protruded therefrom;
- two motors, which are disposed in the motor housing on the slanted motor supporting platforms respectively, each having a driving shaft outwardly extended therefrom; and
- two ventilating fans detachably attached on the driving shafts for being driven to rotate respectively.

DETAILED DESCRIPTION OF THE PREFERRED EMBODIMENT

Figure 1:
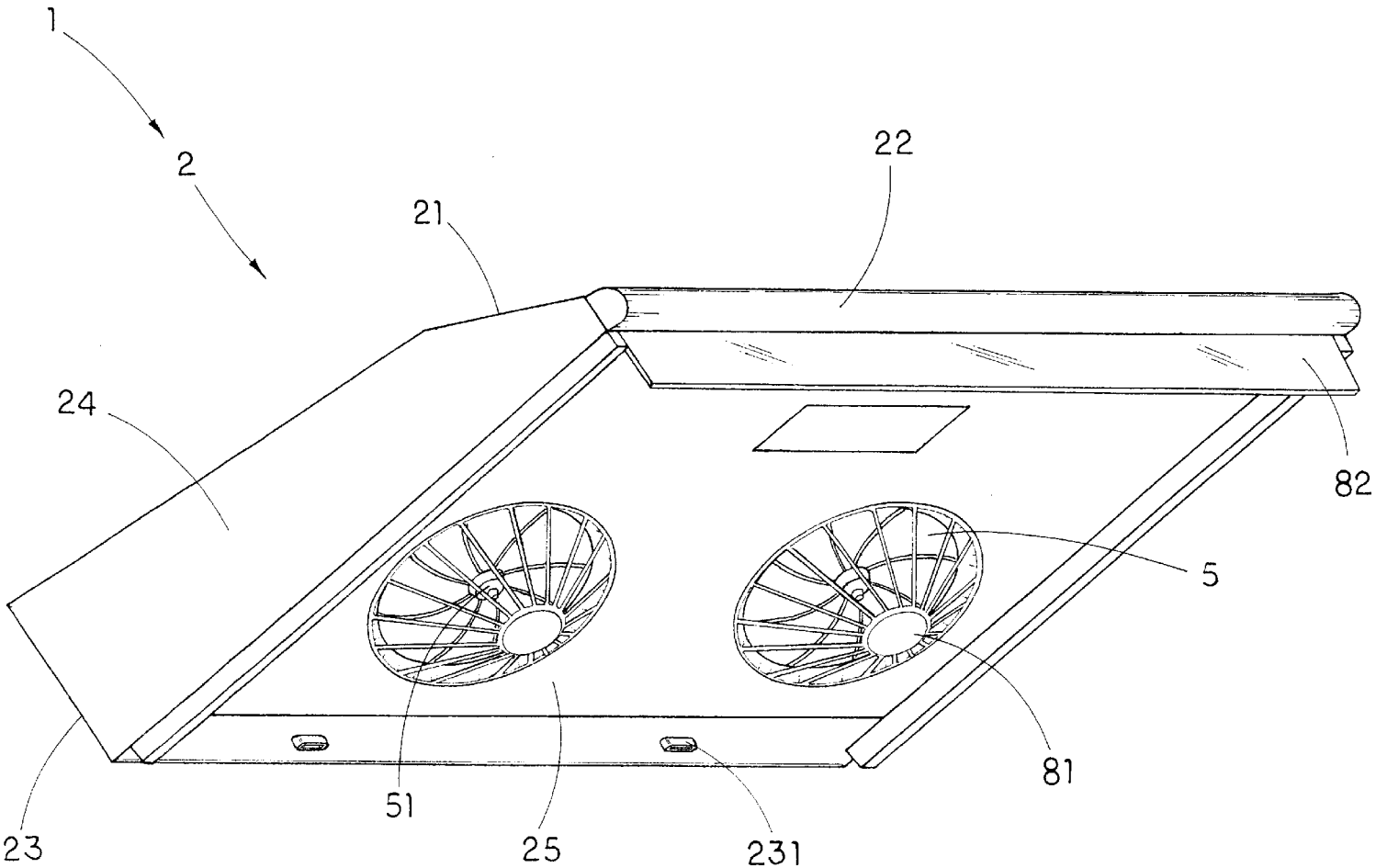
FIG. 1 is a perspective view of a slanted motor housing for range hood according to a preferred embodiment of the present invention.

Referring to FIGS. 1 to 4 of the drawings, a range hood 1 according to a preferred embodiment of the present invention is illustrated, which comprises a casing 2, a motor housing 3, two motors 4, and two ventilated fans 5.

The casing 2, which has a trapezoid cross sectional structure adapted for securely mounted on a ceiling of a kitchen, comprises a ceiling 21, a front panel 22, a rear panel 23, two trapezoid shaped side panels 24, and a base cover 25 having a rear side pivotally mounted on the rear plane 23 and a front side detachably attached to the front panel 22, so as to adapt for pivotally opening and closing, wherein two circular vent holes 251 are provided on the base cover 25. Furthermore, a pair of electrical terminals 26 are mounted inside the front panel 22 of the casing 2.

The motor housing 3, which is disposed in the casing 2, comprises a horizontal top panel 31 detachably mounted on the horizontal ceiling 21 of the casing 2 by an attaching means 6 and a shelter 32 mounted on the top panel 31. The shelter comprises two circular motor covers 321 aligned with the two vent holes 251 of the base cover 25 respectively.

Two slanted motor supporting platforms 311 are protruded downwardly from the top plane 31 and coaxially aligned with the two motor covers 321 of the shelter 32 respectively. Each slanted motor supporting platforms 311 has in circular shape and is integrally and inwardly protruded from the top panel 31. Each of the slanted motor supporting platforms 311 has a thickness gradually increase from its front portion to its rear portion such that the slanted motor supporting platform 311 is inclined for a predetermined angle A, for example 5 to 30 degrees, with respect to the horizontal top panel 31, as shown in FIG. 4.

The two motors 4, which are disposed in the motor housing 3, each comprises a driving shaft 41 coaxially extended therefrom. The two motors 4 are detachably mounted on the two slanted motor supporting platforms 311 of the top panel 31 respectively by the attaching means 6, so that the two motors 4 are supported inclinedly wherein the driving shaft 41 of each of the motors 4 is frontwardly inclined for the predetermined angle A with respect to the vertical.

Figure 4:
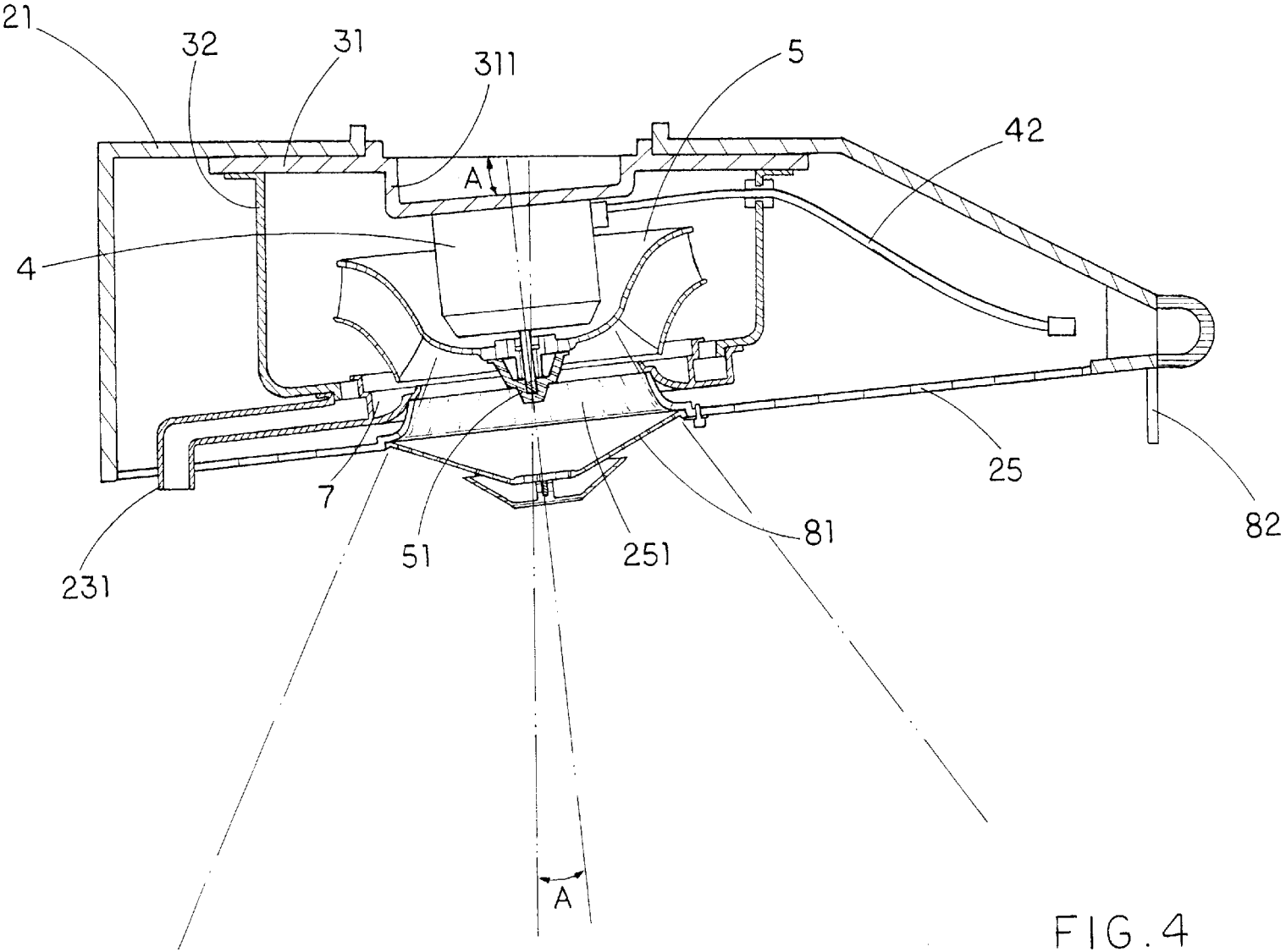
FIG. 4 is a side sectional view of the slanted motor housing for range hood according to the above preferred embodiment of the present invention.

The two motor covers 321 of the shelter 32 surround the two motors 4 respectively, wherein each of the two motor covers 321 has a rear portion thicker than a front portion and a central axis of each of the circular motor covers 321 is also inclined for the predetermined angle A with respect to the vertical, as shown in FIG. 4. A pair of conducting wires 42 are extended from the two motors 4 to the two terminals 26 of the casing 2 through the motor housing 3 respectively, wherein each conducting wire 42 has a connector 421 at its free ends such that the conducting wires 42 are adapted to connect or disconnect to the terminals 26 by plugging or unplugging the connectors 421 to the terminals 26 respectively.

The two ventilating fans 5 are detachably attached on the driving shafts 41 of the motors 4 and disposed inside the two motor covers 321 of the motor housing 3 respectively, wherein the two ventilating fans 5 are arranged to have the same respective slanted angle to the motors 4 and to be driven by the motors 4 to rotate 4 through their driving shafts 41 respectively in order to suck the vaporized grease into the range hood 1. In order to securely mount the ventilating fan 5 to the motor 4, a locker cap 51 is detachably attached to a free end of the respective driving shaft 41. In such arrangement, the ventilating fan 5 can be detached for easy clean up after the locker cap 51 is unscrewed from the driving shaft 41.

Accordingly, in order to cover the slanted motors 4, the shelter 32 of the motor housing 3 is arranged to be a trapezoid cross sectional structure so as to fitly dispose the motors 4 therein. The shelter 32 has a height gradually increase from a front thereof to the back such that the openings of the motor covers 321 are coaxially parallel to the ventilating fans 5. In such arrangement, according to the fluid dynamic air flow, the air will flow from the narrow portion (the front portion) to the wide portion (the rear portion) of the shelter 32 with less air friction. As a result, the range hood 1 will highly increase the amount of air dragging into the range hood 1.

The range hood 1 further comprises a pair of grease collectors 7 each detachably mounted on an opening of the respective motor cover 321 of the shelter 32 of the motor housing 3. Each grease collector 7 comprises a circular hollow body 71 encircling the opening of the motor cover 321 and an elongated guiding slot 72 is mounted on the hollow body 71 such that the heavy grease sucked inside the range hood 1 will drop off to the hollow body 71 and will be collected into the guiding slot 72. An elongated tube body 73 is integrally and rearwardly extended from the hollow body 71 to the rear panel 23 of the casing 2 wherein a L-shaped tube extension 74 is fittedly connected between a free end of the tube body 73 and a grease outlet 231 on the rear panel 23 of the casing 2. So, the grease collected in the guiding slot 72 of the hollow body 71 will further drain off from the grease outlet 231 of the casing 2 of the range hood 1 through the tube body 73 and the tube extension 74 respectively.

The range hood 1 further comprises a housing handle 322, a pairs fan guards 81 detachably mounted on the base cover 25 and an air regulator 82 slidably mounted on the front portion the base cover 25. The housing handle 322 is firmly affixed on an outer surface of the shelter 32 of the motor housing 3 wherein the user can easily handle and carry the motor housing 3 when the motor housing 3 is detached from the casing 2. Each fan guard 81 having a circular shape coaxially and encirclingly mounted on each vent hole 251 of the base cover 25 in order to protect the ventilating fans 5 and motors 4 from being attacked while operation and prevent a child from putting his or her hand to the high revolution of the ventilating fans 5. The air regulator 82 which has a rectangular shape is horizontally mounted on the front portion of the base cover 25 so that the air above the range hood 1 will not be sucked therein by the high power of the motors 4. Therefore, the air regulator 82 will help to block and regulate the air above the range hood 1 such that the ventilating fans 5 will more effectively suck the air below the range hood 1 positioned above the cooking burners.

Figure 2:
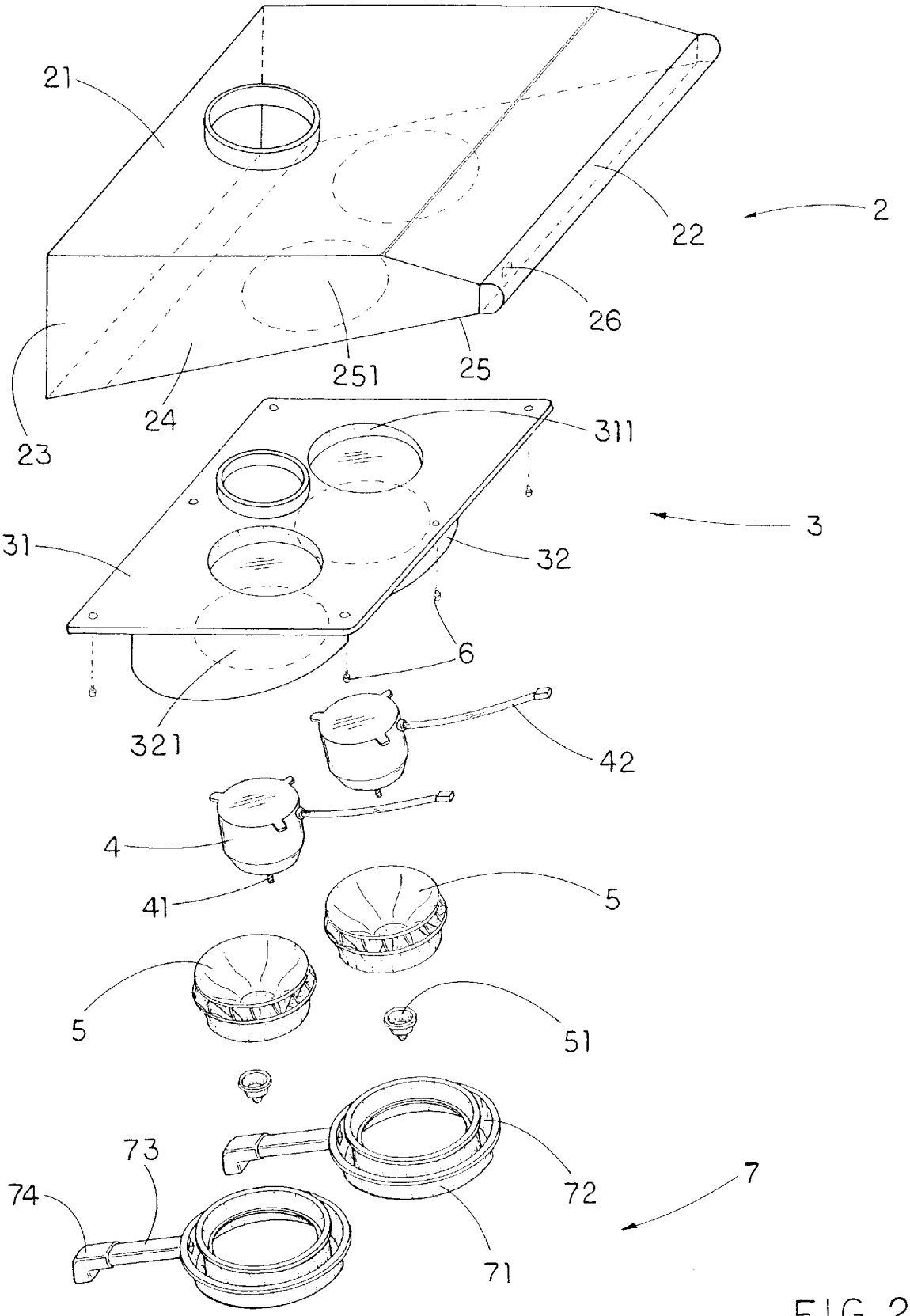
FIG. 2 is an exploded perspective view of the slanted motor housing for range hood according to the above preferred embodiment of the present invention.
Figure 3:
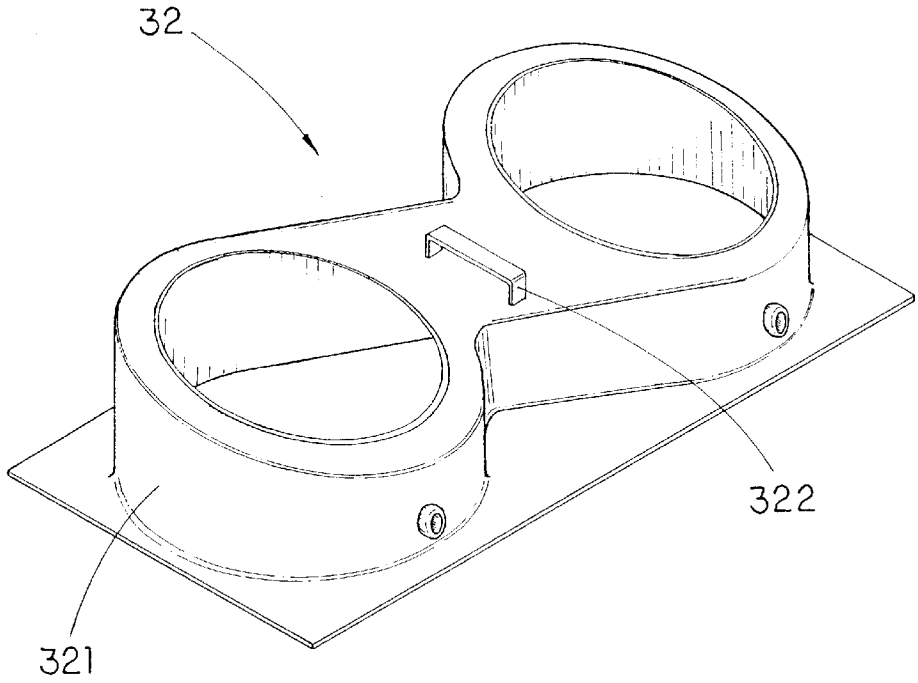
FIG. 3 is an exploded perspective view of the motor housing of the range hood according to the above preferred embodiment of the present invention.
Figure 3:
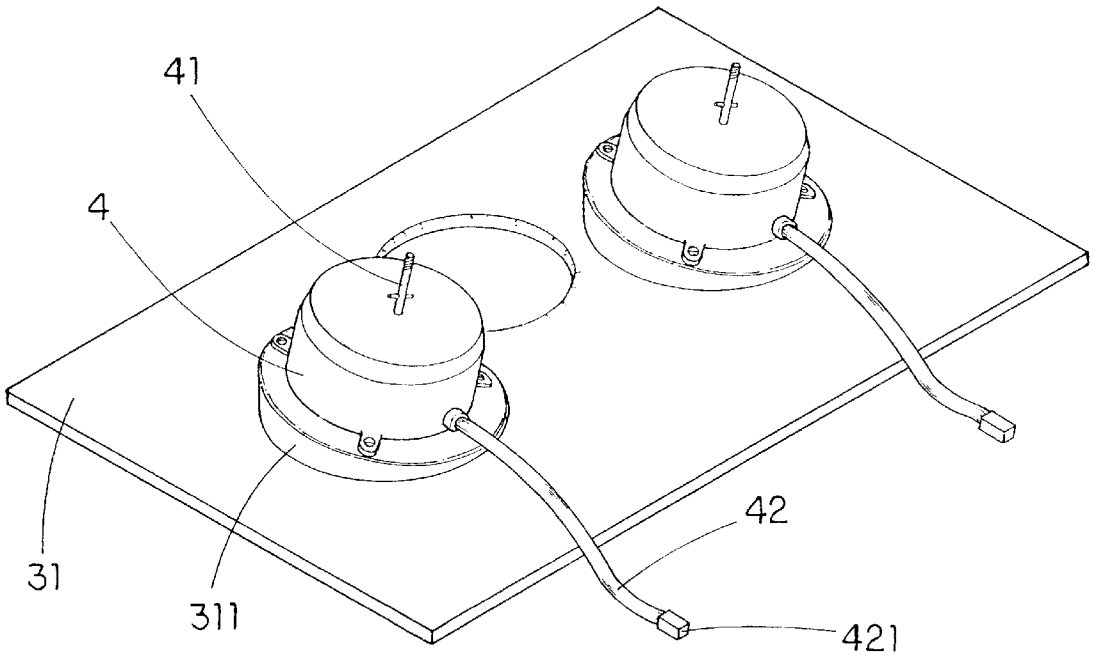

Referring to FIG. 2, all parts of the range hood 1, including the fan guard 81, grease collector 7, ventilating fans 5, motors 4, and the motor housing 3, can be disassembled for easy clean up and dishwasher-safe except the motors 4. The base cover 25 can be pivotally open and detach from the casing 2. The motor housing 3 and the motors 4 are adapted to be detached by unfastening the attaching means 6. Accordingly, the attaching means 6 may comprises a plurality of handy screws 61 wherein each of the handy screws 61 has an elongated head portion such that the user is able to twist the screw 61 by hand for screwing or unscrewing operation.

In view of the above disclosure of the preferred embodiment, it is apparent that the present invention can achieve the following advantages:

(1) The maintenance of the range hood 1 is simple and easy. All parts of the range hood 1 including the motors 4 are easily disassembled to facilitate the user to clean up the range hood 1 parts by parts and most of the parts are made of durable plastic which are dishwasher-safe. So that, the range hood 1 is easy to keep clean in order to have a better performance.

(2) The efficiency of sucking the cooking contaminants from the cooking burners can be highly increased. According to the fluid dynamic air flow, the shape of the motor housing 3 will highly increase the air flow of the range hood 1. The air inside the motor housing 3 will flow and be compressed from the front portion (with lesser volume) and the rear portion (with larger volume) of the motor housing 3 so as to increase the sucking effect of the range hood 1.

(3) The motors and the fans are arranged inclinedly so as to increase the suction area of the range hood 1 to more effectively cover the two front cooking burners. However, the motor and fan of the conventional range hood are perpendicularly mounted above the cooking burners so that the suction area can mainly cover the two rear cooking burners. The slanted motor housing 3 of the present invention will rotate the displacement of the motors 4 forwardly such that the suction area of the range hood 1 will automatically spread out for covering the more cooking area.

(4) Accordingly, the range hood 1 of the present invention can be assembled or disassembled without using any tools. The handy screws 61 of the attaching means 6 enable the user to remove or attach the assembly parts by hands.

(5) The collected grease is easy to drain off the range hood 1. The grease collector 7 is detachably and encirclingly mounted on the opening of the motor cover 321 with the respective slanted angle of the motor housing 3, as shown in FIG. 4. So, the collected grease will be drained off along the inclined grease collector 7 and out of the casing 2.

What is claimed is:

1. A range hood, comprising:

a casing which includes a ceiling, a front panel, a rear panel, two side panels, and a base cover, wherein two circular vent holes are provided on said base cover;

a slanted motor housing, which is disposed in said casing, comprising a top panel detachably mounted on said ceiling of said casing and a shelter mounted on said top panel, wherein said shelter comprises two circular motor covers aligned with said two vent holes of said base cover respectively, wherein two slanted motor supporting platforms are protruded downwardly from said top plane and coaxially aligned with said two motor covers of said shelter respectively, each of said slanted motor supporting platforms having a circular shape and being integrally and inwardly protruded from said top panel, each of said slanted motor supporting platforms having a thickness gradually increase from a front portion to a rear portion thereof, wherein said slanted motor supporting platform is inclined for a predetermined angle with respect to said top panel;

two motors, which are disposed in said motor housing, each comprising a driving shaft coaxially extended therefrom, wherein said two motors are detachably mounted on said two slanted motor supporting platforms of said top panel respectively in such a manner that said two motors are supported inclinedly wherein said driving shaft of each of said motors is frontwardly inclined for said predetermined angle with respect to vertical, wherein said two motor covers of said shelter surround said two motors respectively, wherein each of said two motor covers has a rear portion thicker than a front portion and a central axis of each of said circular motor covers is also inclined for said predetermined angle with respect to said vertical; and two ventilating fans detachably attached to said driving shafts of said motors and disposed inside said two motor covers of said motor housing respectively, wherein said two ventilating fans are arranged to have said same respective slanted angle to said motors and to be driven by said motors to rotate through their driving shafts respectively.

2. A range hood, as recited in claim 1, further comprising a pair of locker caps detachably attached to free ends of said two driving shafts respectively.

3. A range hood, as recited in claim 1, wherein said base cover has a rear side pivotally mounted on said rear plane and a front side detachably attached to said front panel.

4. A range hood, as recited in claim 2, wherein said base cover has a rear side pivotally mounted on said rear plane and a front side detachably attached to said front panel.

5. A range hood, as recited in claim 1, further comprising a pair of electrical terminals mounted inside said front panel of said casing and a pair of conducting wires extended from said two motors to said two terminals of said casing through said motor housing respectively, wherein each conducting wire has a connector at free ends thereof in such a manner that said conducting wires are adapted to connect and disconnect to said terminals by plugging and unplugging said connectors to said terminals respectively.

6. A range hood, as recited in claim 4, further comprising a pair of electrical terminals mounted inside said front panel of said casing and a pair of conducting wires extended from said two motors to said two terminals of said casing through said motor housing respectively, wherein each conducting wire has a connector at free ends thereof in such a manner that said conducting wires are adapted to connect and disconnect to said terminals by plugging and unplugging said connectors to said terminals respectively.

7. A range hood, as recited in claim 1, further comprising a pair of grease collectors each detachably mounted on an opening of said respective motor cover of said shelter of said motor housing.

8. A range hood, as recited in claim 7, wherein each of said grease collectors comprises a circular hollow body encircling said opening of said motor cover and an elongated guiding slot mounted on said hollow body in such a manner that grease sucked inside said range hood drops off to said hollow body and be collected into said guiding slot.

9. A range hood, as recited in claim 8, further comprising an elongated tube body integrally and rearwardly extended from said hollow body to said rear panel of said casing wherein a L-shaped tube extension is fittedly connected between a free end of said tube body and a grease outlet on said rear panel of said casing, so as to drain off said grease collected in said guiding slot of said hollow body from said grease outlet of said casing of said range hood through said tube body and said tube extension respectively.

10. A range hood, as recited in claim 9, further comprising a housing handle and a pairs fan guards detachably mounted on said base cover and an air regulator slidably mounted on said front portion said base cover, wherein said housing handle is firmly affixed on an outer surface of said shelter of said motor housing and each of said fan guards is coaxially and encirclingly mounted on each of said vent holes of said base cover in order to protect said ventilating fans and motors, wherein said air regulator which has a rectangular shape is horizontally mounted on said front portion of said base cover.

11. A range hood, as recited in claim 1, further comprising an attaching means for detachably mounting said top panel of said slanted motor housing to said ceiling of said casing and detachably mounting said motors to said slanted motor supporting platforms respectively, wherein said attaching means comprising a plurality of handy screws each of which has an elongated head portion for manually twisting for screwing and unscrewing operation.

12. A range hood, as recited in claim 3, further comprising a pair of grease collectors each detachably mounted on an opening of said respective motor cover of said shelter of said motor housing.

13. A range hood, as recited in claim 12, wherein each of said grease collectors comprises a circular hollow body encircling said opening of said motor cover and an elongated guiding slot mounted on said hollow body in such a manner that grease sucked inside said range hood drops off to said hollow body and be collected into said guiding slot.

14. A range hood, as recited in claim 13, further comprising an elongated tube body integrally and rearwardly extended from said hollow body to said rear panel of said casing wherein a L-shaped tube extension is fittedly connected between a free end of said tube body and a grease outlet on said rear panel of said casing, so as to drain off said grease collected in said guiding slot of said hollow body from said grease outlet of said casing of said range hood through said tube body and said tube extension respectively.

15. A range hood, as recited in claim 14, further comprising a housing handle and a pairs fan guards detachably mounted on said base cover and an air regulator slidably mounted on said front portion said base cover, wherein said housing handle is firmly affixed on an outer surface of said shelter of said motor housing and each of said fan guards is coaxially and encirclingly mounted on each of said vent holes of said base cover in order to protect said ventilating fans and motors, wherein said air regulator which has a rectangular shape is horizontally mounted on said front portion of said base cover.

16. A range hood, as recited in claim 15, further comprising an attaching means for detachably mounting said top panel of said slanted motor housing to said ceiling of said casing and detachably mounting said motors to said slanted motor supporting platforms respectively, wherein said attaching means comprising a plurality of handy screws each of which has an elongated head portion for manually twisting for screwing and unscrewing operation.

17. A range hood, as recited in claim 5, further comprising a pair of grease collectors each detachably mounted on an opening of said respective motor cover of said shelter of said motor housing.

18. A range hood, as recited in claim 17, wherein each of said grease collectors comprises a circular hollow body encircling said opening of said motor cover and an elongated guiding slot mounted on said hollow body in such a manner that grease sucked inside said range hood drops off to said hollow body and be collected into said guiding slot.

19. A range hood, as recited in claim 18, further comprising an elongated tube body integrally and rearwardly extended from said hollow body to said rear panel of said casing wherein a L-shaped tube extension is fittedly connected between a free end of said tube body and a grease outlet on said rear panel of said casing, so as to drain off said grease collected in said guiding slot of said hollow body from said grease outlet of said casing of said range hood through said tube body and said tube extension respectively.

20. A range hood, as recited in claim 19, further comprising a housing handle and a pairs fan guards detachably mounted on said base cover and an air regulator slidably mounted on said front portion said base cover, wherein said housing handle is firmly affixed on an outer surface of said shelter of said motor housing and each of said fan guards is coaxially and encirclingly mounted on each of said vent holes of said base cover in order to protect said ventilating fans and motors, wherein said air regulator which has a rectangular shape is horizontally mounted on said front portion of said base cover.

* * * * *